US006650063B2

(12) United States Patent
Uemura et al.

(10) Patent No.: US 6,650,063 B2
(45) Date of Patent: Nov. 18, 2003

(54) PLASMA DISPLAY PANEL AND IMAGE DISPLAY DEVICE USING THE SAME

(75) Inventors: Norihiro Uemura, Kokubunji (JP); Kazutaka Tsuji, Hachiouji (JP); Keizo Suzuki, Kodaira (JP); Hiroshi Kajiyama, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/082,088

(22) Filed: Feb. 26, 2002

(65) Prior Publication Data

US 2003/0090206 A1 May 15, 2003

(30) Foreign Application Priority Data

Nov. 9, 2001 (JP) ..... 2001-344228

(51) Int. Cl.[7] ..... G09G 3/10; H01J 17/49

(52) U.S. Cl. ..... 315/169.4; 313/485; 313/509; 313/586

(58) Field of Search ..... 315/169.4; 313/485, 313/489, 506, 509, 581, 582, 576, 586, 635, 643; 445/24

(56) References Cited

U.S. PATENT DOCUMENTS 6,061,040 A * 5/2000 Onodera et al. ..... 345/67
6,066,917 A * 5/2000 Funada ..... 313/587
6,160,345 A * 12/2000 Tanaka et al. ..... 313/489
6,419,540 B1 * 7/2002 Tanaka et al. ..... 445/24

* cited by examiner

*Primary Examiner*—Don Wong
*Assistant Examiner*—Thuy Vinh Tran
(74) *Attorney, Agent, or Firm*—Antonelli, Terry, Stout & Kraus, LLP

(57) ABSTRACT

A plasma display panel comprises a transparent front panel plate including a display electrode and a protective layer covering at least the display electrode, a back panel plate, a discharge space formed by adhering the transparent front panel plate and the back panel plate to each other, and a phosphor layer formed to be exposed to the inside of the discharge space. The protective layer is made of a first metal oxide layer formed to cover the display electrode, and a second metal oxide layer formed to cover the first metal oxide layer. The linear thermal expansion coefficient of the second metal oxide layer is larger than that of the first metal oxide layer.

8 Claims, 4 Drawing Sheets

PLASMA DISPLAY PANEL AND IMAGE DISPLAY DEVICE USING THE SAME

BACKGROUND OF THE INVENTION

1. Field of the Invention

The present invention relates to a plasma display panel, and an image display device using the same, particularly to a plasma display panel, which may be abbreviated to a PDP hereinafter, suitable for making display images highly minute, and an image display device using the same.

2. Description of the Related Prior Art

An AC plane-discharge type PDP is a display device wherein a great number of minute discharge spaces (discharge cells) airtightly closed between two glass panel plate are set up. Referring to a drawing, this AC plane-discharge type PDP will be briefly described hereinafter. FIG. 2 is a perspective exploded view illustrating a part of an ordinary PDP structure. The PDP illustrated in FIG. 2 is a panel wherein a front panel plate 21 made of glass and a back panel plate 28 made of glass are adhered to and integrated with each other, and is a reflection type PDP wherein phosphor layers 32 emitting red (R), green (G) and blue (B) rays are formed on the side of the back panel plate 28.

The front panel plate 21 has a pair of sustaining electrodes, which are also called display electrodes, formed on its face opposite to the back panel plate 28 and in parallel to have regular intervals.

The pair of sustaining electrodes is composed of transparent common electrodes (hereinafter referred to merely as X electrodes) 22-1, 22-2, . . . , and transparent independent electrodes (hereinafter referred to merely as Y electrodes or scanning electrodes) 23-1, 23-2, . . . .

In the X electrodes 22-1, 22-2, . . . , non-transparent X bus electrodes 24-1, 24-2, . . . for compensating for the conductivity of the transparent electrodes are set up to extend in the direction shown by an arrow D2 in FIG. 2, and in the Y electrodes 23-1, 23-2, . . . , Y bus electrodes 25-1, 25-2, . . . are set up to extend in the same direction.

The X electrodes 22-1, 22-2, . . . , the Y electrodes 23-1, 23-2, . . . , the X bus electrodes 24-1, 24-2, . . . , and the Y bus electrodes 25-1, 25-2, . . . are insulated from the discharge spaces, in order to be AC-driven. In other words, these electrodes are covered with a dielectric layer 26 composed of a low melting point glass layer which generally has a thickness of several tens of microns. This dielectric layer 26 is covered with a metal oxide layer 27.

As the metal oxide layer 27, there is generally used a magnesium oxide (MgO) layer formed by EB vapor deposition and having a thickness of about 1 $\mu$m. This magnesium oxide layer has a high secondary electron emission factor and excellent resistance against sputtering by ions, and functions so as to cause an improvement in discharge characteristics.

The above-mentioned metal oxide layer is generally called "protective layer". An example thereof is a single layer composed of a magnesium oxide layer which is directly formed on a display electrode by chemical vapor deposition (CVD), as disclosed in JP-A-10-261362.

The back panel plate 28 has, on its face opposite to the front panel plate 21, address electrodes (hereinafter referred to merely as A electrodes) crossing three-dimensionally and perpendicularly to the X electrodes 22-1, 22-2, . . . , and the Y electrodes 23-1, 23-2, . . . of the front panel plate 21.

The A electrodes 29 are set up to extend in the direction shown by an arrow D1 in FIG. 2. Barrier ribs 31 for separating the A electrodes 29 from each other are set up in order to prevent the expanding of discharge (regulate the region of discharge). The pair of sustaining electrodes composed of the X electrode and the Y electrode may also be separated from each other by means of the barrier rib along the direction shown by the arrow D2. The respective phosphor layers 32 emitting red, green and blue light rays are successively applied in the form of stripes so as to cover groove faces between the barrier ribs 31.

FIG. 3 is a view showing the structure of a main cross section of the PDP, as is viewed along the direction shown by the arrow D2 in FIG. 2, and illustrates a single discharge cell, which is the smallest unit of a cell. In FIG. 2, the boundaries of the discharge cell are roughly shown by broken lines. The inside of a discharge space 33 is filled with a discharge gas (e.g., a mixed rare gas such as helium, neon, argon, krypton or xenon) for generating plasma.

When a voltage is applied between the X display electrodes and the Y display electrodes, plasma 10 is generated by electrolytic dissociation of the discharge gas. FIG. 3 schematically illustrates a situation in which the plasma 10 is generated. Ultraviolet rays from this plasma excite the phosphors 32 to emit fluorescent rays. The fluorescent rays from the phosphors 32 are emitted through the front panel plate 21 outside the discharge cells. The rays emitted from the respective discharge cells constitute images on a display screen.

In the case of attempting to make the PDP highly minute, the gap distance (discharge gap) between the X-Y display electrodes must be made narrow with an improvement in the minuteness of the discharge cells. When the discharge gap is made narrow, the electric field intensity between the electrodes increases. As a result, sputtering is promoted with an increase in ion impact against the protective layer. By the sputtering, the protective layer is stricken off and the dielectric is made naked so that the discharge becomes unstable. Consequently, the panel cannot be driven. In other words, a problem that the lifetime of the panel becomes short arises.

In order to prevent the reduction in the lifetime of the panel, the protective layer should be made thick. According to the prior art, however, as the protective layer is made thicker, a large number of cracks are generated. It is therefore impossible to make the thickness of the protective layer sufficiently thick.

Since the protective layer cannot be easily made thick in the prior art as described above, it is indispensable to form the dielectric layer for insulating the electrodes from discharge. It is difficult to cut off this step of forming the dielectric layer.

Furthermore, with an improvement in the minuteness of the discharge cells (reduction in the cell pitch), the ratio of the luminescent area in the PDP is reduced; therefore, a drop in display brightness thereof is also caused.

SUMMARY OF THE INVENTION

Therefore, in order to overcome the above-mentioned problems in the prior art, a first object of the present invention is to provide a plasma display panel wherein a drop in the brightness thereof with an improvement in the minuteness thereof can be prevented and the luminescent efficiency thereof to applied electric power can be improved by making a high-quality and thick protective layer. A second object of the present invention is to provide a plasma display device having this plasma display panel.

In the case that a metal oxide layer such as a MgO layer is formed as a protective layer on a glass panel plate or a dielectric layer, the linear thermal expansion coefficient of this metal oxide layer is generally larger that of the glass panel plate or the dielectric layer as an undercoat. Therefore, with a drop in temperature after the formation of the layer, tensile stress acts on the formed metal oxide layer so that cracks are generated in the metal oxide layer.

The number of the generated cracks becomes larger as the thickness of the metal oxide layer becomes larger. Incidentally, in order to reduce the number of the generated cracks, it is advisable to decrease the difference in linear thermal expansion coefficient between the above-mentioned glass panel plate or dielectric layer and the above-mentioned metal oxide layer. In this way, the metal oxide layer can be made so as to have a larger thickness and higher-quality.

Therefore, the above-mentioned object of the present invention can be attained in the way that a protective layer covering a display electrode set on a transparent panel plate, such as a glass panel plate, constituting a front panel plate of a plasma display panel (hereinafter referred to as a transparent front panel plate is made of: a bi-layered metal oxide layer composed of a first metal oxide layer for decreasing the difference in linear thermal expansion coefficient and a second metal oxide layer covering the first metal oxide layer.

More specifically, the first metal oxide layer desirably comprises a metal oxide polycrystal layer which has a larger linear thermal expansion coefficient than a transparent front panel plate or a dielectric layer and which is, for example, made of MgO or made mainly of MgO. The second metal oxide layer desirably comprises a metal oxide polycrystal layer which has a larger secondary electron emission coefficient than the transparent front panel plate or the dielectric layer, which has a larger linear thermal expansion coefficient than the first metal oxide layer, and which is, for example, made of at least one selected from $CeO_2$, CaO and $TiO_2$ or made mainly of at least one selected from the same group.

It is allowable that the first and second metal oxide layers contain an inevitable amount of an impurity which is naturally incorporated. Correspondingly to this fact, the above-mentioned wording "made mainly of" is used.

A dielectric layer may be set between the metal oxide layer and the display electrode on the transparent front panel plate. According to the present invention, however, the protective layer can be made thick as described above. It is therefore sufficient that only the above-mentioned bi-layered metal oxide layer is directly formed on the display electrode without forming any dielectric layer. In this case, the step of forming the above-mentioned dielectric layer can be cut off. Thus, costs for the process for producing the PDP can be reduced.

About the protective layer composed of the bi-layered metal oxide layer of the present invention, it is desired that the total layer thickness of the first metal oxide layer and the second metal oxide layer is set to at least 2 $\mu$m. In the case of a protective layer composed of a single layer of MgO in the prior art, a problem that the number of cracks increases from 15 or 16 to several tens if the thickness thereof is set to 2 $\mu$m or more. However, according to the present invention, when the total layer thickness of the bi-layered metal oxide layer is from 2 to 5 $\mu$m, cracks are not generated at all. When the layer thickness is set to 10 to 40 $\mu$m, only about 3 to 9 cracks are generated. The number of the generated cracks is remarkably reduced. Thus, the PDP of the present invention can be sufficiently put to practical use.

DESCRIPTION OF THE PREFERRED EMBODIMENTS

Figure 1:
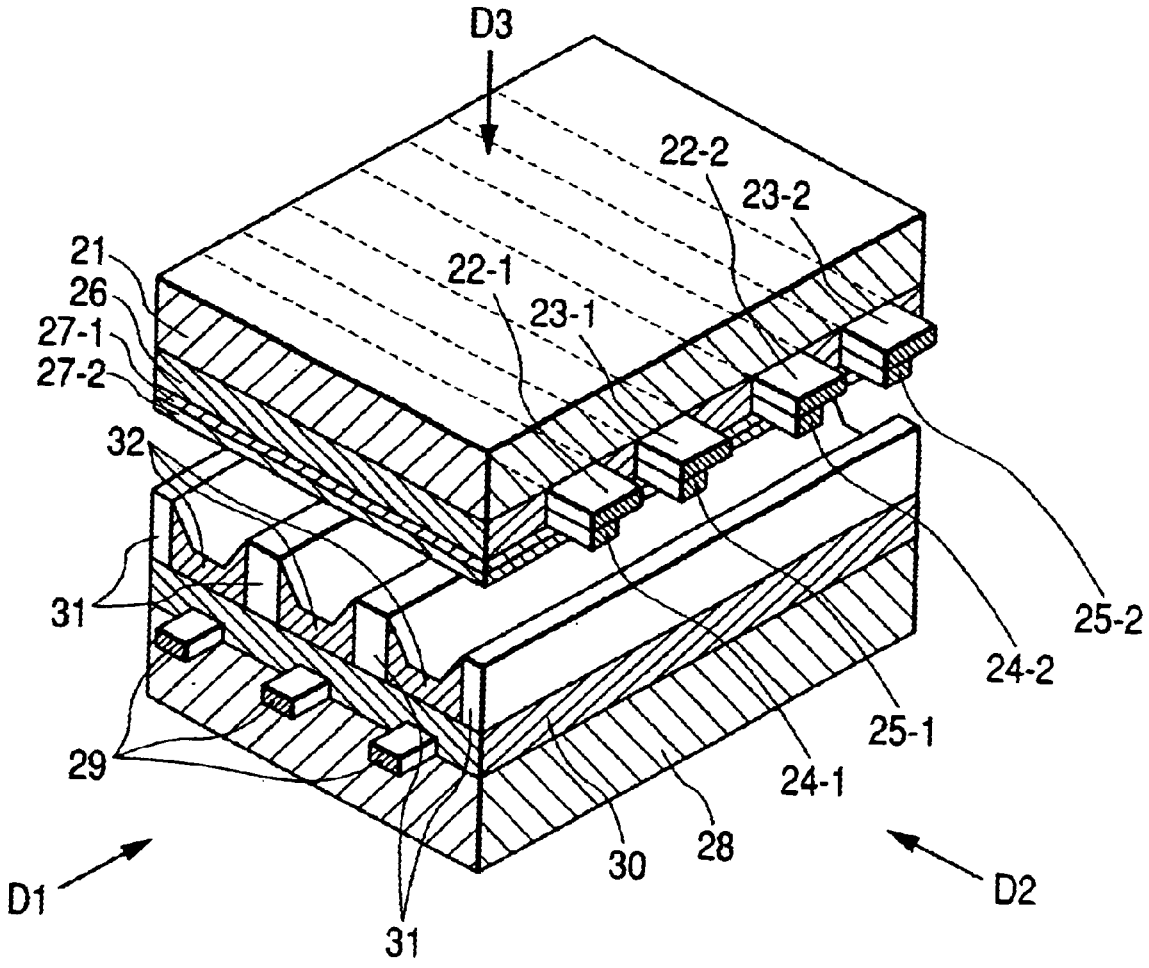
FIG. 1 is a perspective exploded view illustrating a portion of the panel structure of a plasma display panel in a plasma display device according to Example 1 of the present invention.
Figure 2:
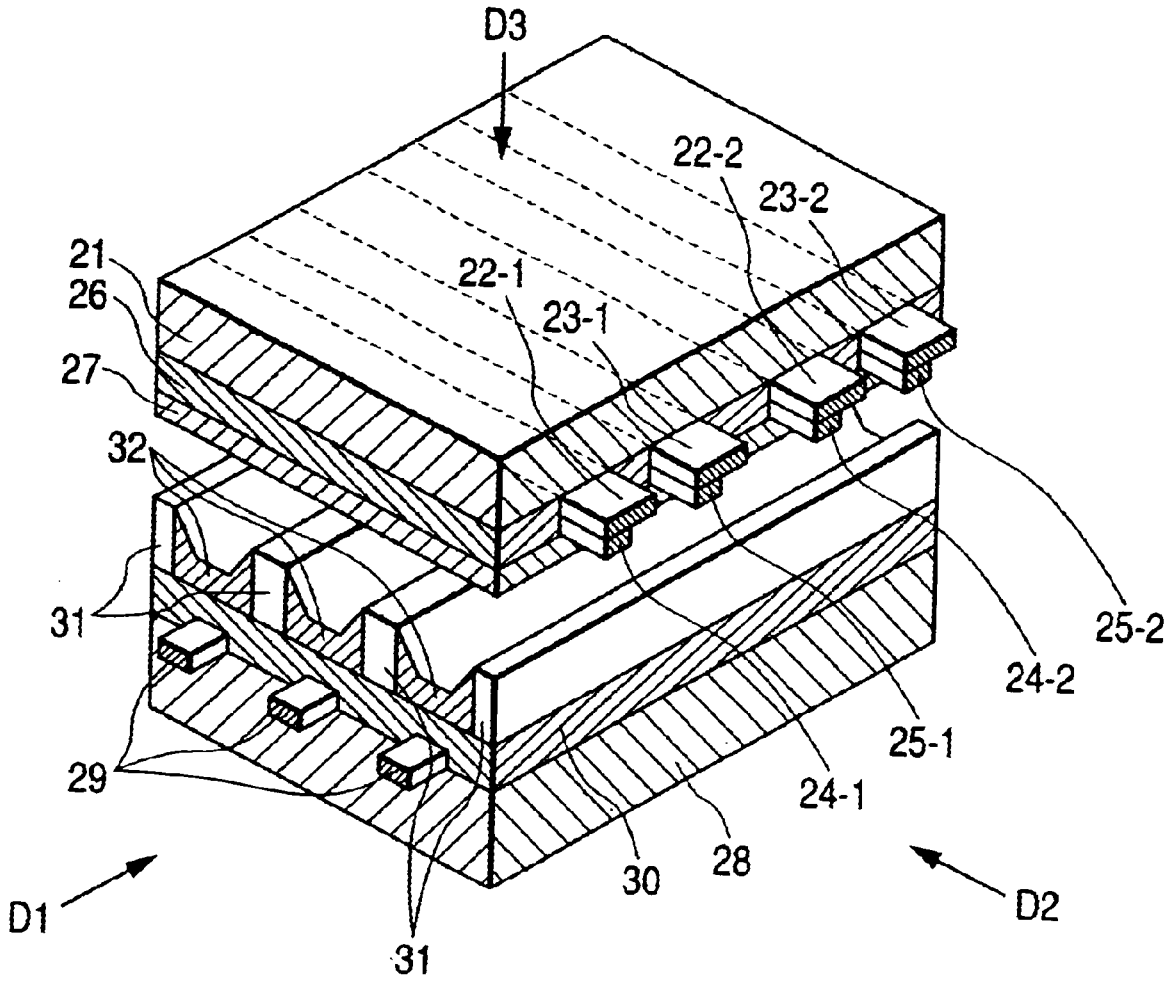
FIG. 2 (PRIOR ART)
FIG. 2 is a perspective exploded view illustrating a portion of the panel structure of a plasma display panel to which the present invention is applied.
Figure 3:
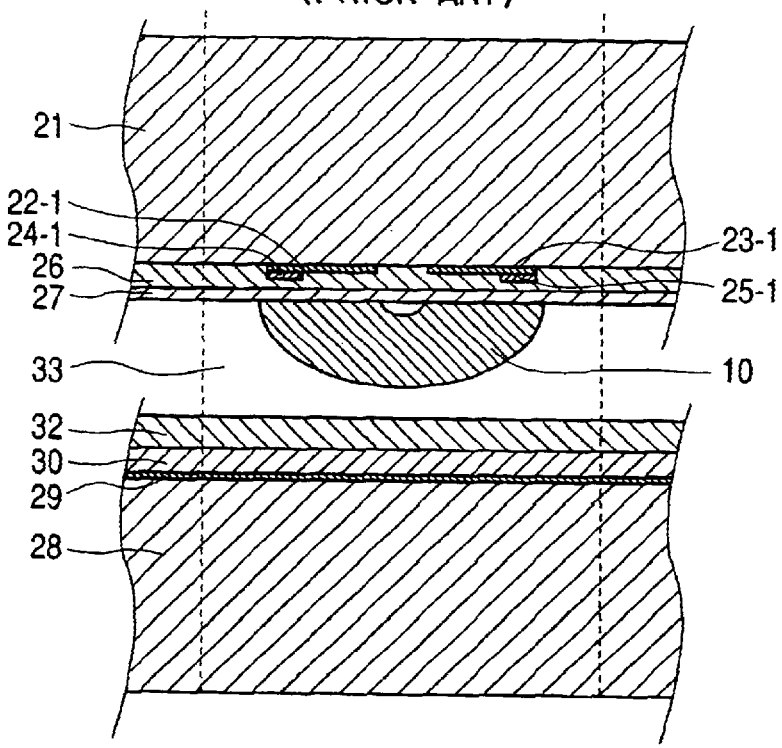
FIG. 3 (PRIOR ART)
FIG. 3 is a sectional view illustrating a main sectional structure of the plasma display panel, as is viewed along the D2 direction in FIG. 2, and shows only one discharge cell.

The following will describe specific structural features of the present invention for attaining the objects of the present invention.

(1) A first aspect of the present invention is a plasma display panel comprising a transparent front panel plate comprising a display electrode and a metal oxide layer covering the display electrode, a back panel plate, a discharge space formed by adhering the transparent front panel plate and the back panel plate to each other, and a phosphor layer formed to be exposed to the inside of the discharge space, wherein the metal oxide layer is made of a first metal oxide layer formed to cover the display electrode, and a second metal oxide layer formed to cover the first metal oxide layer, and the linear thermal expansion coefficient of the second metal oxide layer is larger than that of the first metal oxide layer.

(2) A second aspect of the present invention is the first aspect of the present invention wherein a dielectric layer is arranged between the display electrode and the metal oxide layer, and the linear thermal expansion coefficient of the first metal oxide layer is larger than that of the dielectric layer.

(3) A third aspect of the present invention is the first aspect of the present invention wherein the metal oxide layer is directly formed on the display electrode.

(4) A fourth aspect of the present invention is any one of the 1st to the 3rd aspects of the present invention wherein the total layer thickness of the first metal oxide layer and the second metal oxide layer is at least 2 $\mu$m.

(5) A fifth aspect of the present invention is any one of the 1st to the 4th aspects of the present invention wherein the second metal oxide layer is a metal oxide layer made of MgO or made mainly of MgO.

(6) A sixth aspect of the present invention is any one of the 1st to the 4th aspects of the present invention wherein the first meal oxide layer is a metal oxide layer made of at least one selected from $CeO_2$, CaO and $TiO_2$ or made mainly of at least one selected from $CeO_2$, CaO and $TiO_2$.

(7) A seventh aspect of the present invention is any one of the 1st to the 6th aspects of the present invention wherein the transparent front panel plate comprises a glass panel plate, X-Y display electrodes formed on the surface thereof, and a metal oxide layer formed to cover the surface of the display electrodes; the back panel plate comprises, thereon, address electrodes, spaces positioned on the address electrodes and partitioned by means of a dielectric and a partition, and a phosphor layer formed inside the spaces; the spaces are formed as discharge spaces by adhering the transparent front panel plate and the back panel plate to each other in the manner that the X-Y display electrodes and the address electrodes cross three-dimensionally; and a rare gas for generating plasma discharge is airtightly charged into the spaces.

(8) An eight aspect of the present invention is an image display device, comprising the plasma display panel according to any one of the 1st to 7th aspects of the present invention, and a driving device comprising a control circuit for driving the plasma display panel.

Referring to the drawings, examples of the present invention will be more specifically described hereinafter.

EXAMPLE 1

FIG. 1 is a perspective exploded view illustrating a portion of the panel structure of a PDP according to one example of the present invention. In FIG. 1, the following are beforehand formed on a front glass panel plate by a well-known method: display electrodes composed of X electrodes 22, X bus electrodes 24, Y electrodes 23 and Y bus electrodes 25; and a low melting point glass layer as a dielectric layer 26, which has a thickness of 40 $\mu$m and is formed to cover the display electrodes.

A protective layer (metal oxide layer) 27 covering the dielectric layer 26 (linear thermal expansion coefficient: ~$8\times10^{-6}$ 1/° C.) has a bi-layered structure composed of a first metal oxide layer 27-1 made of CaO (linear thermal expansion coefficient: ~$10.2\times10^{-6}$ 1/° C.) and a second metal oxide layer 27-2 made of MgO (linear thermal expansion coefficient: ~$13\times10^{-6}$ 1/° C.)

The metal oxide layer 27 is formed using the so-called ion implanting type vacuum layer formation apparatus, wherein ingredients of the metal oxide layer evaporated by electron beam irradiation are caused to pass through a high-frequency coil and deposited on the plate 21.

As the ingredient of the metal oxide layer 27-1, calcium oxide (CaO) particles are used. Oxygen gas is supplied to the vacuum layer formation apparatus to form the metal oxide layer 27-1 made of CaO. The temperature of heating the plate 21 upon the layer-formation is set to 150° C., and oxygen gas is supplied to the vacuum layer formation apparatus at a pressure of $2\times10^{-2}$ Pa.

As the ingredient of the metal oxide layer 27-2, magnesium oxide (MgO) particles are used. Oxygen gas is supplied to the vacuum layer formation apparatus to form the metal oxide layer 27-2 made of MgO. The temperature of heating the plate 21 upon the layer-formation is set to 100° C., and oxygen gas is supplied to the vacuum layer formation apparatus at a pressure of $2\times10^{-2}$ Pa. The layer thickness of the metal oxide layer 27-1 made of CaO and that of the metal oxide layer 27-2 made of MgO are selected from various combinations. The apparatus for forming the metal oxide layers 27-1 and 27-2 is not necessarily limited to the above-mentioned ion implanting type vacuum layer formation apparatus.

The layer quality of each protective layer 27 formed by the above-mentioned method was evaluated. The results are shown in Table 1 described below. For comparison, a single layer made of magnesium oxide (MgO) was formed as a comparative example according to the prior art, and the layer quality thereof was also evaluated. The results thereof are also shown in Table 1. The layer thickness of this single layer made of magnesium oxide (MgO) was set to the thickness equal to the total layer thickness of the metal oxide layers 27-1 and 27-2 in the present example. The present test was performed using 15 cm×15 cm test panels. The layer quality of the formed protective layer was evaluated by counting the number of generated cracks.

TABLE 1

Relationship between layer thickness and the number of cracks

| Comparative example according to the prior art | | Examples | |
|---|---|---|---|
| MgO thickness thickness | Number of cracks | CaO + MgO layers thickness | Number of cracks |
| 1 $\mu$m | 0 | 0.5 $\mu$m + 0.5 $\mu$m | 0 |
| 2 $\mu$m | 17 | 1 $\mu$m + 1 $\mu$m | 0 |
| 5 $\mu$m | 24 | 2.5 $\mu$m + 2.5 $\mu$m | 0 |
| 10 $\mu$m | 43 | 5 $\mu$m + 5 $\mu$m | 3 |
| 20 $\mu$m | — | 10 $\mu$m + 10 $\mu$m | 5 |
| 40 $\mu$m | — | 20 $\mu$m + 20 $\mu$m | 9 |

By using the metal oxide layer to decrease the difference in linear thermal expansion coefficient between the dielectric and the protective layer, tensile stress applied to the metal oxide layer 27-2 on the basis of a drop in temperature after the formation of the layers was reduced so that the number of generated cracks dropped sharply. Particularly when the total layer thickness of the first and second metal oxide layers was 2 $\mu$m or more, the effect of reducing the number of generated cracks was remarkably exhibited.

Namely, as is evident from Table 1, when the total layer thickness of the first and second metal oxide layers was from 2 to 5 $\mu$m, the number of generated cracks was zero; when the thickness was from 10 to 20 $\mu$m, the number was from 3 to 5; and when thickness was 40 $\mu$m, the number was very small, that is, 9. If the number of generated cracks is about 10 in display panel products, the products can be sufficiently put to practical use. It can be therefore understood that even the resultant products wherein the total layer thickness of the first and second metal oxide layers was as large as about 40 $\mu$m can be sufficiently put to practical use.

Furthermore, the highly minute panel (PDP) having the protective layer 27 having a total layer thickness of 2 $\mu$m and produced in the present example was used to perform a lifetime test. As a result, it was proved that because the thickness of the protective layer was sufficiently large, the dielectric layer 26 as an undercoat was not made naked even by sputtering effect based on intenser ion impact with the improvement in the minuteness, and sufficient lifetime could be obtained.

EXAMPLE 2

Figure 4:
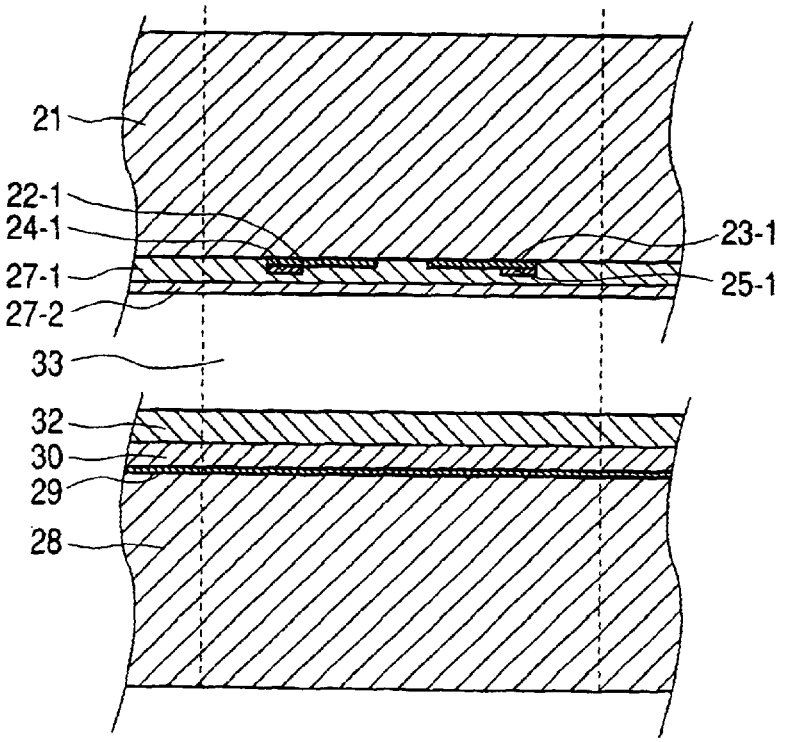
FIG. 4 is a sectional view illustrating a main sectional structure of a plasma display panel according to Example 2 of the present invention, and shows only one discharge cell.

FIG. 4 is a sectional view of a PDP according to another example of the present invention, as is viewed along the D2 direction in FIG. 1. In the present example, without the use of the dielectric layer 26 covering the above-mentioned display electrodes, the first metal oxide layer 27-1 was directly formed on the display electrodes set on the glass panel plate 21.

$CeO_2$ (linear thermal expansion coefficient: ~$8.6\times10^{-6}$ 1/° C.) was formed into a first metal oxide layer 27-1 covering display electrodes formed on a glass panel plate (linear thermal expansion coefficient: ~$8\times10^{-6}$ 1/° C.), and MgO (linear thermal expansion coefficient: ~$13\times10^{-6}$ 1/° C.) was formed into a second metal oxide layer 27-2 covering the metal oxide layer.

The layer thickness of the first metal oxide layer 27-1 was set to 4 μm, and that of the second metal oxide layer 27-2 was set to 4 μm. The linear thermal expansion coefficient of the glass panel plate 21 is substantially equal to that of the dielectric layer 26 (linear thermal expansion coefficient: ~$8\times10^{-6}$ 1/° C.). Thus, for the same reason as in Example 1, a thick protective layer wherein the number of generated cracks was small could be formed.

A test panel (15 cm×15 cm) according to the present example was used to compare it with a comparative example according to the prior art. The panels used in the evaluation were different only in the structure of their dielectric layers and protective layers (metal oxide layers). Needless to say, the two were the same in the structure of other parts. Results about the evaluation of the discharge start voltage (i.e., firing potential) and the efficiency of the test panels are shown in Table 2.

TABLE 2

| Evaluation of the firing voltage and the efficiency | | |
|---|---|---|
| Evaluation items | Comparative example according to the prior art | Example |
| Firing voltage | 200 V | 145 V |
| Efficiency (relative value) | 1 | 1.26 |

The firing voltage is a voltage at discharge starts to be caused when voltage pulses having a width of 4 82 s and a period of 10 μs are alternately applied to the X electrodes (22-1,22-2, . . . ) and Y electrodes (23-1, 23-2, . . . ) (the voltage pulses applied to the X electrodes are shifted by 5 μs from those applied to the Y electrodes).

As is evident from Table 2, the firing voltage was 145 V in the present example, and was reduced by 55 V from the comparative example according to the prior art. The efficiency is a value obtained by dividing the brightness of the panel by applied electric power, and was evaluated on the basis of a value relative to the comparative example (value: 1). The pulse voltage applied to the X electrodes and the Y electrodes at this time was set to 200 V in the comparative example and was set to 145 V in the present example. As a result, the efficiency of the panel of the present example was 1.26 times larger than that of the comparative example.

Next, the concentration of Xe in the discharge gas was changed in the panel (PDP) of the present example, to produce a trial panel. The trial panel was compared with a comparative panel. The results are shown in Table 3 described below.

The composition of the discharge gas and the pressure of the charged gas in the present example were set to Ne(70%)-Xe(30%) and 660 hPa, respectively, and those in the comparative panel were set to Ne(96%)-Xe(4%) and 660 hPa, respectively. As the concentration of Xe was increased, the discharge voltage rose. Therefore, no discharge could be generated in the comparative panel according to the prior art.

In the panel of the present example, however, the discharge voltage was reduced. Therefore, even if the concentration of Xe in the present example was made larger than in the prior art, sufficient discharge could be generated. The voltage pulses applied for the evaluation of the efficiency were the same as described above. The applied pulse voltage was 200 V in the two cases.

TABLE 3

| Discharge gas and efficiency | | |
|---|---|---|
| Conditions and evaluation items | Comparative example | Example |
| Discharge gas | Ne(96%)-Xe(4%), 660 hPa | Ne(70%)-Xe(30%), 660 hPa |
| Efficiency (relative value) | 1 | 1.97 |

In the panel of the present example, unnecessary was the step of forming the dielectric layer 26 in the panel of the above-mentioned comparative example according to the prior art. For this reason, it is possible to make the time required for the production process shorter and make production costs lower than in the above-mentioned panel of the comparative example.

The results of the example shown in Table 2 demonstrate that the PDP can be driven by an applied pulse voltage of 145 V. Accordingly, the breakdown voltage of condensers or FETs used in the driving circuit for the PDP in the present invention may be lower than in conventional PDPs which are driven by a voltage of 200 V. Consequently, circuit costs can be reduced according to the present invention.

As described above, according to the present invention, a thick and high-quality protective layer composed of two metal oxide layers can be formed, so that the protective layer functions sufficiently as an insulating layer for AC-driving; therefore, a conventional dielectric layer becomes unnecessary and advantageous effects such as an improvement in efficiency and a drop in costs can be obtained.

A driving circuit was connected to the PDP of the present example, to fabricate a display device. Furthermore, a video signal source for sending video signals to this display device was connected to this display device, to construct a display system. Images on this system were then evaluated. As a result, the resultant display system was a system capable of displaying bright and beautiful images and being inexpensively produced even if the highly minute PDP was used.

Figure 6:
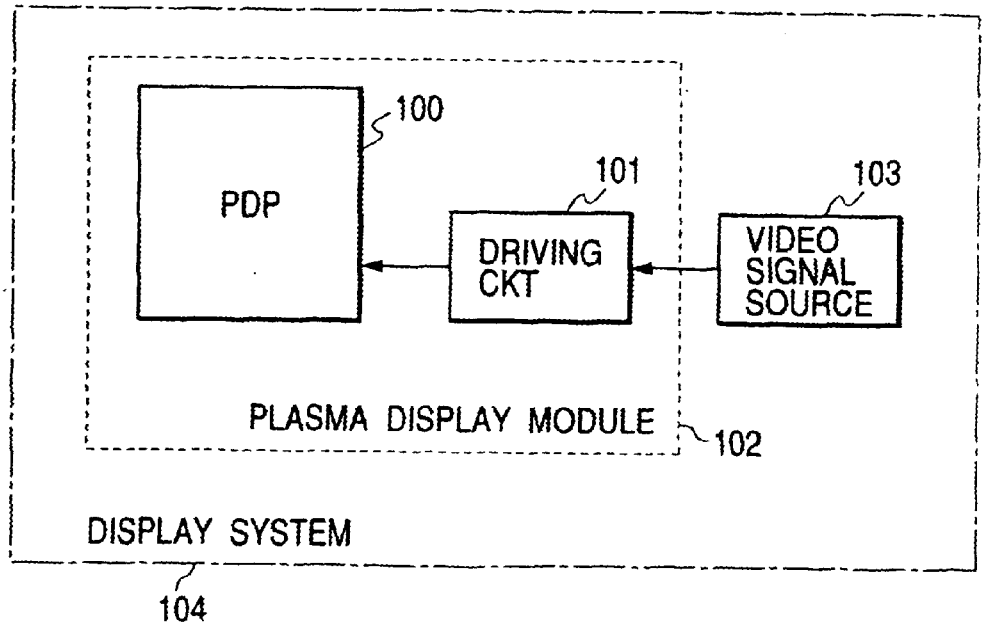
FIG. 6 is a block diagram showing the outline of a display system having a plasma display panel according to the present invention.

FIG. 6 is a block diagram showing a display system 104, which is an example according to the present invention. A PDP 100 and a driving circuit 101 for driving the PDP 100 constitute a image display device (plasma display device) 102, and this module and a video signal source 103 for sending video signals to the display device 102 constitute the display system 104.

EXAMPLE 3

Figure 5:
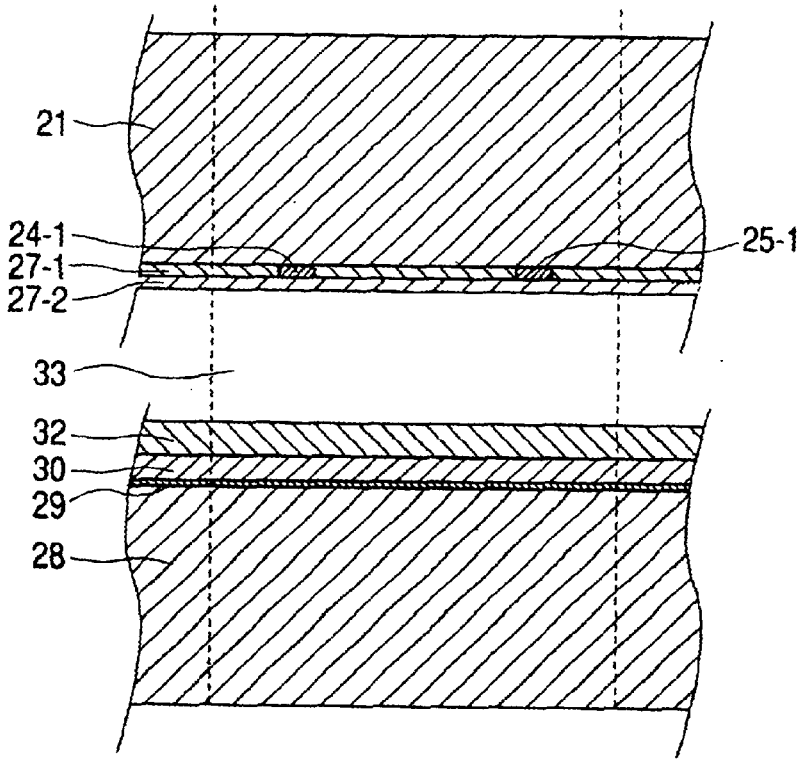
FIG. 5 is a sectional view illustrating a main sectional structure of a plasma display panel according to Example 3 of the present invention, and shows only one discharge cell.

FIG. 5 is a sectional view of a highly minute PDP according to a further example of the present invention, as is viewed along the D2 direction. In the present example, the display electrodes of the PDP shown in FIG. 4 and described in Example 2 were composed of only bus electrodes. That is, in the present example, the transparent electrodes (the X electrodes 21 and the Y electrodes 23) were removed.

The width of the X bus electrode 24-1 and that of the Y bus electrode 25-1 were set to 50 μm, respectively, and the gap distance between the X bus electrode 24-1 and the Y bus electrode 25-1 was 40 μm. The intervals between the barrier ribs were 200 μm, and the size of the discharge cells was 0.2 mm×0.2 mm. That is, the present PDP had a highly minute structure. The size of the cells in the present example was about ½ of the size (0.4 mm×0.13 mm) of cells in the prior art.

The used protective layer was composed of a $TiO_2$ layer (linear thermal expansion coefficient: ~$8.3\times10^{-6}$ 1/° C.) as the first metal oxide layer 27-1 and a MgO layer (linear thermal expansion coefficient: ~$13\times10^{-6}$ 1/° C.) as the second metal oxide layer 27-2. The layer thickness of the first metal oxide layer was 4 μm, and that of the second metal oxide layer was also 4 μm. Other structures of the PDP were the same as described in Example 2 and shown in FIG. 4. The composition of the discharge gas was Ne(70%)-Xe (30%). The pressure of the charged gas was 660 hPa, and applied pulse voltage was 200 V. Under these conditions, the brightness of the PDP was evaluated.

As a result, the brightness was 612 cd/cm$^2$ at a white peak, and a reduction in the peak brightness, based on an improvement in the minuteness, was suppressed. Moreover, a lifetime test caused no problem, and a problem of a drop in the lifetime, based on the improvement in the minuteness, could be solved.

Furthermore, the step of forming the X electrodes and the Y electrodes can be cut off. As a result, the time required for the production process and production costs can be evidently reduced.

As described in detail above, the desired objects can be attained by the present invention. That is, it is possible to realize an improvement in the minuteness of a PDP, omit any dielectric layer and cover display electrodes of the PDP directly with a metal oxide layer, and reduce production process costs and driving costs.

Moreover, the brightness and the efficiency of the panel can be improved (or a drop in the panel b brightness with the improvement in the minuteness can be prevented). Using the plasma display device of the present invention, an image display system which can display bright and beautiful images can be obtained at low costs.

What is claimed is:

1. A plasma display panel comprising:

a transparent front panel plate including a display electrode and a protective layer covering the display electrode;

a back panel plate;

a discharge space formed by adhering the transparent front panel plate and the back panel plate to each other; and a phosphor layer formed to be exposed to the inside of the discharge space, wherein the protective layer is made of a first metal oxide layer formed to cover the display electrode, and a second metal oxide layer formed to cover the first metal oxide layer, and the linear thermal expansion coefficient of the second metal oxide layer is larger than that of the first metal oxide layer.

2. The plasma display panel according to claim 1, wherein a dielectric layer is arranged between the display electrode and the protective layer, and the linear thermal expansion coefficient of the first metal oxide layer of the protective layer is larger than that of the dielectric layer.

3. The plasma display panel according to claim 1, wherein the protective layer is directly formed on the display electrode.

4. The plasma display panel according to any one of claims 1 to 3, wherein the total layer thickness of the first metal oxide layer and the second metal oxide layer is at least 2 μm.

5. The plasma display panel according to any one of claims 1 to 3, wherein the second metal oxide layer is a metal oxide layer made of MgO or made mainly of MgO.

6. The plasma display panel according to any one of claims 1 to 3, wherein the first metal oxide layer is a metal oxide layer made of at least one selected from $CeO_2$, CaO and $TiO_2$ or made mainly of at least one selected from $CeO_2$, CaO and $TiO_2$.

7. The plasma display panel according to any one of claims 1 to 3, wherein:

the transparent front panel plate comprises a glass panel plate, X-Y display electrodes formed on the surface thereof, and a protective layer made of metal oxide layer and formed to cover the surface of the display electrodes;

the back panel plate comprises, thereon, address electrodes, spaces positioned on the address electrodes and partitioned by means of a dielectric and a partition;

the phosphor layer being formed inside the spaces;

the spaces are formed as discharge spaces by adhering the transparent front panel plate and the back panel plate to each other in a manner that the X-Y display electrodes and the address electrodes cross three-dimensionally; and a rare gas for generating plasma discharge is airtightly charged into the spaces.

8. An image display device, comprising the plasma display panel according to any one of claims 1 to 3, and a driving device comprising a control circuit for driving the plasma display panel.

* * * * *